United States Patent [19]

Brooks et al.

[11] 4,212,730

[45] Jul. 15, 1980

[54] APPARATUS FOR SEPARATING AND CLASSIFYING DIVERSE, LIQUID-SUSPENDED SOLIDS

[76] Inventors: George C. Brooks, 1414 Collins La.; James R. Brown, 932 Wedgewood La., both of Lakeland, Fla. 33803

[21] Appl. No.: 887,498

[22] Filed: Mar. 17, 1978

[51] Int. Cl.[2] ..... B03D 1/14

[52] U.S. Cl. ..... 209/168; 210/221 P

[58] Field of Search ..... 209/164, 162, 168–170; 261/DIG. 75; 210/221

[56] References Cited

U.S. PATENT DOCUMENTS

| | | | |
|---|---|---|---|
| 1,141,377 | 6/1915 | Callow | 209/170 |
| 1,167,835 | 1/1916 | Norris | 209/170 |
| 1,642,051 | 9/1927 | Wall | 209/170 X |
| 1,767,400 | 6/1930 | Remick | 209/170 |
| 2,753,045 | 7/1956 | Hollingsworth | 209/170 |
| 2,938,629 | 5/1960 | Hollingsworth | 209/170 |
| 3,400,818 | 9/1968 | Tarjan | 209/170 |

FOREIGN PATENT DOCUMENTS

| | | | |
|---|---|---|---|
| 875031 | 4/1953 | Fed. Rep. of Germany | 209/170 |
| 602202 | 3/1926 | France | 209/170 |

*Primary Examiner*—Robert Halper

*Attorney, Agent, or Firm*—Duckworth, Hobby, Allen & Pettis

[57] ABSTRACT

Apparatus for utilizing the flotation separation process employs first and second chambers, the first chamber being positioned above the second chamber so that the tailings from the first chamber may be gravity fed into the second chamber. Both chambers include a plurality of spaced, air bubble infusers, each of which are fed by air and water pipes extending across the corresponding chamber. A plug and throat arrangement in a bulkhead between the first and second chambers allows control over the flow of tailings from the first chamber into the second chamber. Each infuser is designed so as to provide an even spread of the air bubbles emitted therefrom.

11 Claims, 5 Drawing Figures

APPARATUS FOR SEPARATING AND CLASSIFYING DIVERSE, LIQUID-SUSPENDED SOLIDS

BACKGROUND OF THE INVENTION

1. Field of the Invention

The present invention relates to methods and apparatus for concentrating minerals by the flotation separation and classification procedure.

2. Description of the Prior Art

In the natural state, certain minerals, such as phosphates, coal and sylvite, are often found admixed with heavier aggregate materials, such as rocks, clay and the like. After mining the mineral in bulk, it is therefore frequently necessary to separate the desired minerals from the undesirable materials.

The process of flotation separation and classification is well known in the prior art for these purposes. Briefly, this process contemplates the mixing of the bulk product in a water slurry with known emulsifiers and surfactants. Air (or another suitable gas) is then bubbled through the slurry and the lighter, desired minerals float to the top with the bubbles, while the undesirable materials (referred to as "tailings") sink to the bottom of the container. A discussion of the flotation separation process is contained in U.S. Pat. No. 2,931,502 to Schoeld, et al. Equipment manufactured by Heyl and Patterson, Inc. of 55 Ft. Pitt Boulevard, Pittsburgh, Pa. under the trademark "CYCLO CELLS" utilizes the flotation separation process.

One of the disadvantages of most flotation separation processes is that frequently large masses of the desired mineral, particularly coarse particles, are not carried to the top of the vessel during the aeration step, and sink to the bottom of the vessel with the "tailings". This results in a low efficiency of recovery of the desired mineral.

SUMMARY OF THE INVENTION

The present invention contemplates apparatus for separating and classifying diverse, liquid-suspended solids and comprises first and second chambers, with the first chamber elevated above the second chamber. Means are provided with each container for feeding a slurry of the diverse, liquid-suspended solids into the first chamber and thereafter into the second chamber. Means are further provided in each chamber for bubbling a fluid having a specific gravity less than that of the liquid, the bubbles being fed through the slurry to float predetermined solids in the slurry upwards to the top of the respective chamber. Means are provided between the first and second chambers for controlling the flow of the slurry between the two chambers. In the preferred embodiment, the slurry is generally a water slurry, and the bubbling fluid comprises air. Since the bulk of finely divided particles are recovered and removed as concentrate in the first chamber, coarse particles often lost to tailings in conventional systems are recovered in the second chamber because of the ability of this apparatus to create tenacious, finely divided bubble structure along with providing additional residence time required in floating coarse particles.

In the preferred embodiment of the present invention, the first chamber is stacked upon the second chamber, and communication between the two chambers is effected by a hole passing through a bulkhead therebetween. A plug and float arrangement is provided in the bulkhead to control the flow of the slurry, as required.

The infusers utilized in conjunction with the apparatus of the present invention are specifically designed to spread evenly the air bubbles emitted therefrom across the respective first or second chambers. This is accomplished by the utilization of centrifugal force of the water about a cavity within the infuser and centrifugally through an outlet adjacent the feed tube for the air. The swirling, centrifugal action of the water at the outlet creates a large number of bubbles which are spread outwardly immediately adjacent the outlet. The present invention further contemplates improved methods for the separation and classification of solids utilizing the flotation separation process.

THE DRAWING

DESCRIPTION OF THE PREFERRED EMBODIMENT

Figure 1:
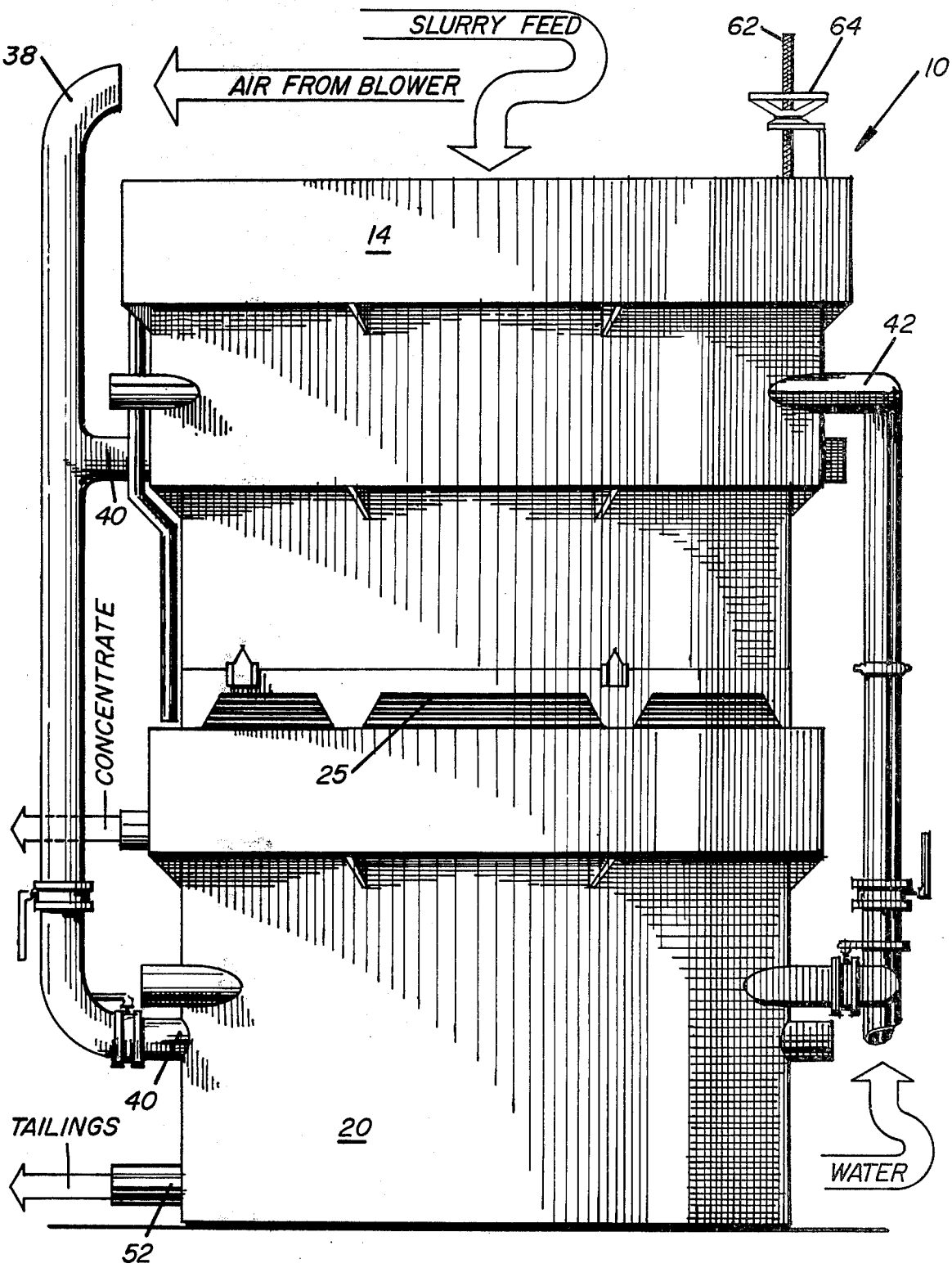
FIG. 1 is a front elevation illustrating apparatus in accordance with the present invention.

The preferred embodiment of the present invention will now be described with reference to FIGS. 1, 2 and 3.

Flotation separation apparatus in accordance with the present invention is referred to generally by the reference numeral 10. The apparatus 10 includes a first chamber 12 defined by a side wall 14 and a bulkhead 16. The side wall 14 is shown as generally cylindrical in shape, it being understood that other shapes may be employed. The apparatus 10 is further provided with a second chamber 18 defined by a side wall 20 and a floor 22, the side wall 20 likewise being generally cylindrical in shape and axial with the cylindrical side wall 14 of the first chamber 12. As shown in FIGS. 1–3, the first and second chambers 12, 18 are disposed in a stacked relationship, communication between the first chamber 12 and the second chamber 18 being effected by a throat 24 extending through the bulkhead 16. With specific reference to FIGS. 1 and 3, it is seen that openings 25 are spaced about the bottom periphery of the interface between the side walls 14, 20.

Figure 2:
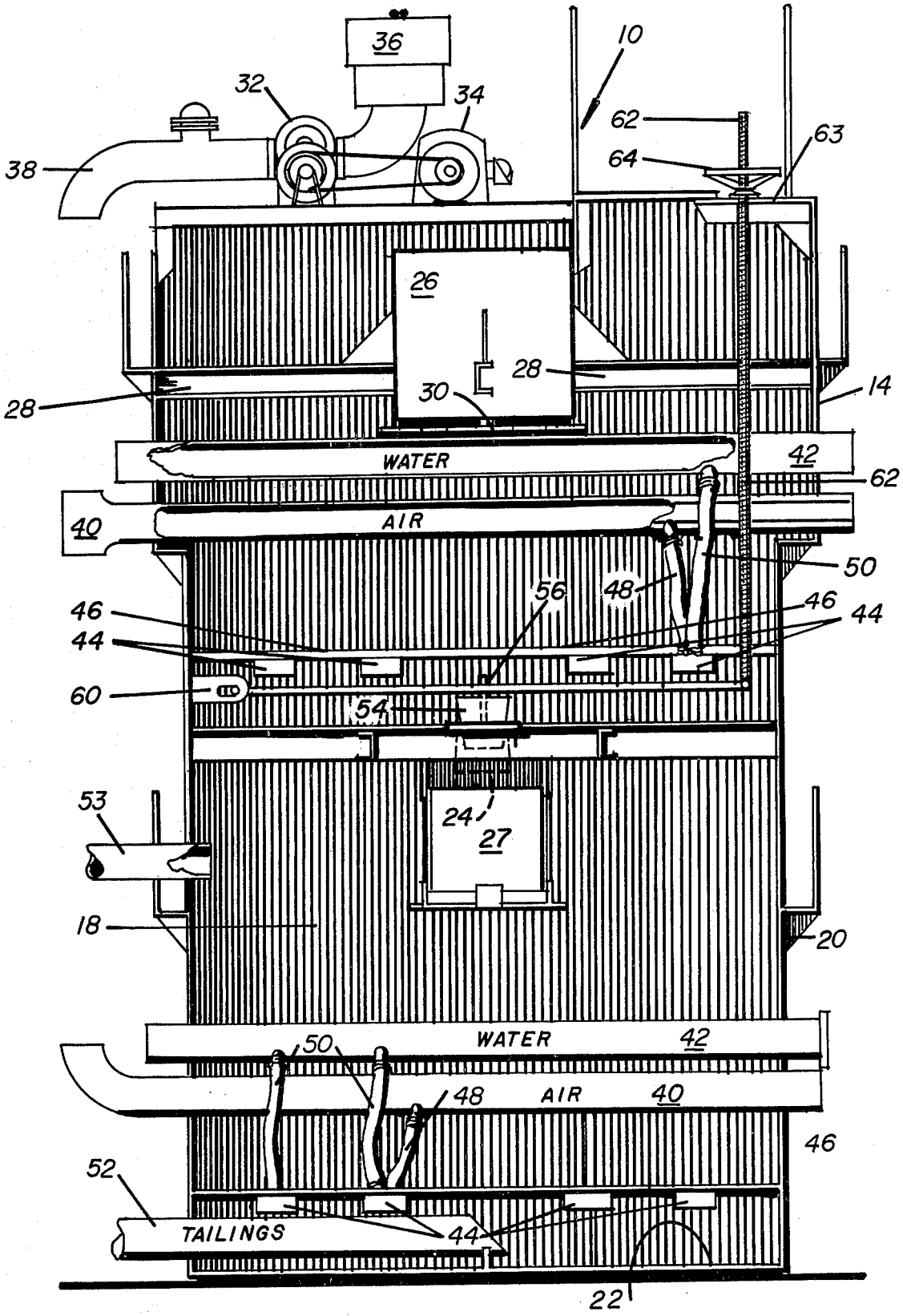
FIG. 2 is a front elevational cross-section similar to the view shown in FIG. 1.
Figure 3:
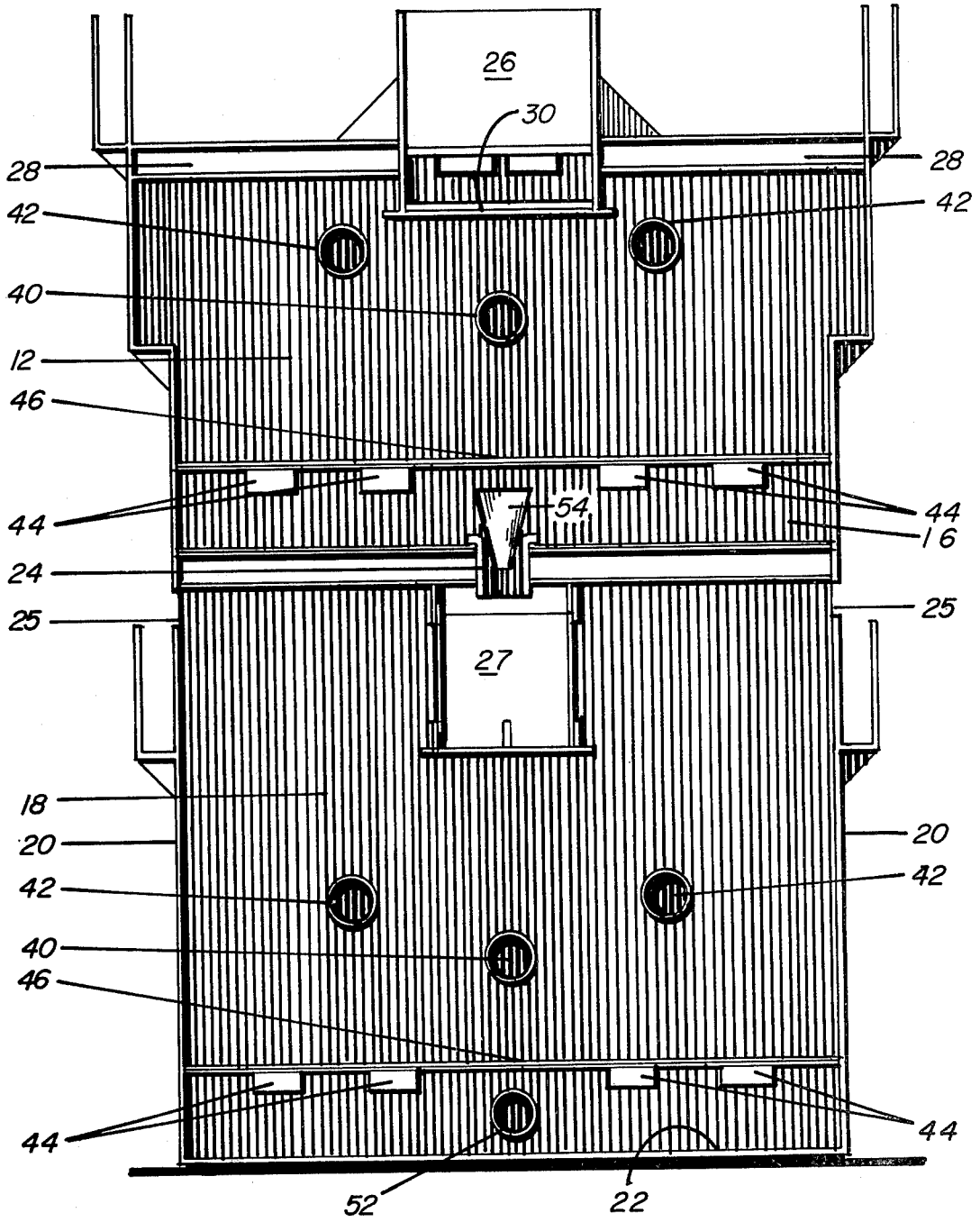
FIG. 3 is a side elevation, taken in cross-section, of the apparatus shown in FIGS. 1 and 2.

Referring to the top of the first chamber 12 as shown in FIG. 2, the apparatus10 includes an intake feed well 26 supported by struts 28 extending to the side wall 14. The port 26 includes a bottom plate 30 having holes (not shown) through which a slurry to be treated can enter the chamber 12. The lower chamber 18 further includes a feed well 27 under the throat 24 having a similar purpose for allowing feed of the slurry from the first chamber 12 into the lower chamber 18.

Referring again to the top of FIG. 2, an air compressor 32 driven by a motor 34 and having an associated air filter 36 is provided. The air compressor 32 pumps air through a supply pipe 38 to additional air pipes 40 extending through the respective side wall 14, 20 and across the respective chamber 12, 18. The ends of the air pipes 40 are capped, so as to pressure feed air to the infusers 44 via an air tube 48, as is described in greater detail below.

Water feed pipes 42 are likewise disposed through the respective side wall 14, 20 and across the respective chambers 12, 18. Water is fed through the pipes 42, which are capped at the end so as to effect a pressure feed of water via a tube 50 into each infuser 44.

With specific reference to FIG. 2, the apparatus 10 is further provided with a plurality of infusers 44 in each chamber 12, 18, all of the infusers being rigidly held by supporting structure 46 bridging the respective side walls 14, 20. The structure of the infusers 44 is described in greater detail below with reference to FIGS. 4 and 5. As described above, each infuser 44 is coupled via the respective air and water tubes 48, 50 to the air and water pipes 40, 42.

As shown at the bottom of FIG. 2, the structure is provided with a tailings outlet 52 extending through the side wall 20 of the lower chamber 18, and a concentrate outlet 53 near the top of the lower chamber.

Again noting FIG. 2, a "dart" or plug 54 is positioned in the port 24 and is movable to control the amount of slurry flow from the upper chamber 12 to the lower chamber 18. The plug 54 is provided with a shaft 56 which is attached to a rocker arm 58 coupled at one end to a pivot 60 mounted on the side wall 14 of the upper chamber 12. The other end of the rocker arm 58 is coupled to a vertical arm 62 which is threaded at the top thereof. The threaded end of the vertical arm 52 extends through a bracket 63 and is threaded through a rotatable hub 64. Rotation of the hub moves the vertical arm 62 up and down, likewise causing corresponding movement of the rocker arm 58, thereby moving the plug 54 into and out of the throat 24 in the desired manner.

The structure of the infusers 44 will now be described with reference to FIGS. 4 and 5.

Figure 5:
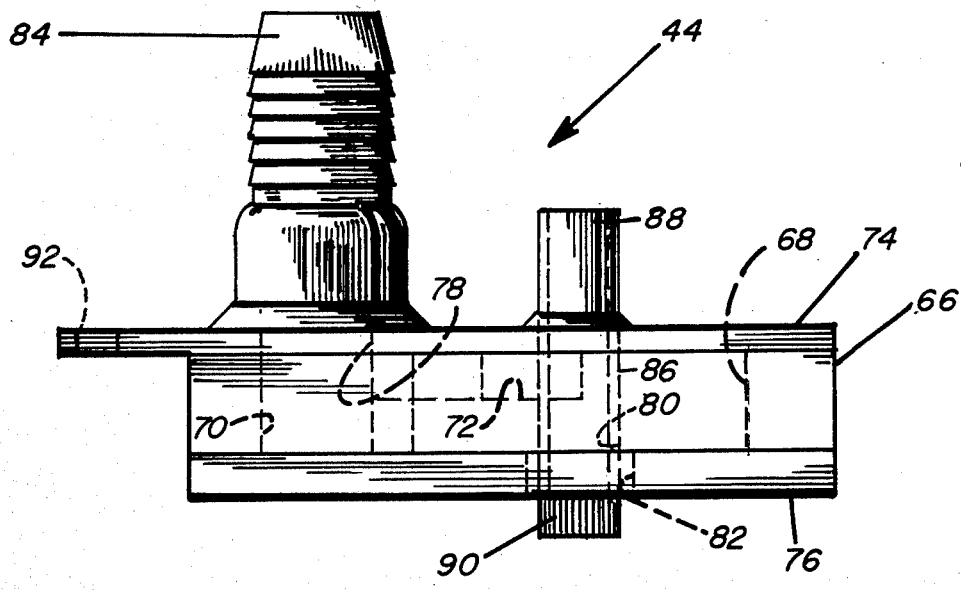
FIG. 5 is a side elevation of the structure shown in FIG. 4.

Noting FIG. 5, the infuser 44 is provided with a plate 66 having a central cavity 68 which is preferably cylindrical in shape. The plate 66 further includes a hole 70 extending therethrough, the hole 70 being spaced from the central cavity 68. A passageway 72 communicates between the hole 70 and the cavity 68, and extends at a tangent to the outer periphery of the central cavity 68.

Figure 4:
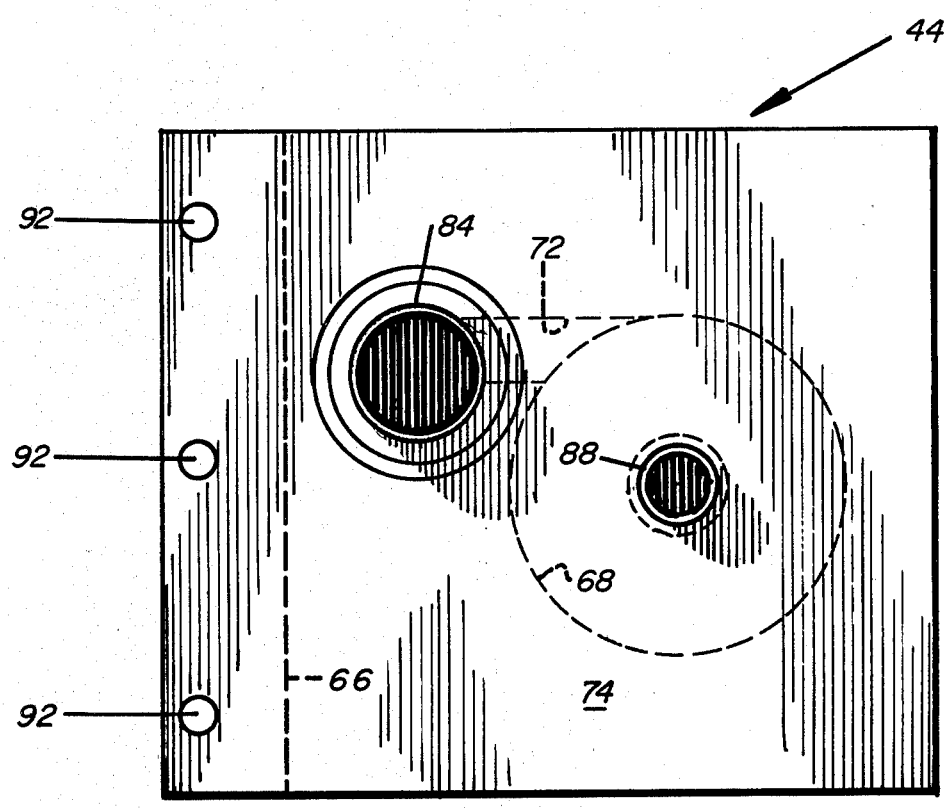
FIG. 4 is a top plan view of a portion of the apparatus shown in FIGS. 1–3.

Reference is now made to both FIGS. 4 and 5. Each infuser 44 is provided with two sheets, 74, 76 laminated on opposing sides of the plate 66. One of the sheets 74, shown as the upper sheet in FIG. 5, includes two holes, 78 and 80 extending therethrough. The first hole 78 is coaxial with the hole 70 in the plate 66, and is of approximately the same dimension. The hole 80 extending in the upper plate 74 is coaxial with the cavity 68, but is of a much smaller dimension. The sheet 76, shown as the lower sheet in FIG. 5, has a hole 82 therein coaxial with the hole 80 and the cavity 68, the hole 82 being substantially smaller than the dimensions of the cavity 68, but somewhat larger than the hole 80.

Each infuser 44 is further provided with a nipple 88 extending coaxial with the hole 78 in the first sheet 68 and the hole 70 in the plate 66. The nipple 84 is adapted to connect with the water feed tube 50, shown in FIG. 2.

Reference is again made to FIG. 5. The infuser 44 is provided with an air feed tube 86, including a nipple 88 extending away from the first sheet 74, through the two sheets 74, 76 and the plate 66. The tube 86 includes an outlet 90 which extends through the hole 82 and slightly beyond the second sheet 76.

As shown in FIGS. 4 and 5, the upper sheet 74 extends beyond the plate 66 and includes mounting holes 92 which allows each infuser 44 to be joined to the respective strap 46 (note FIG. 2).

The method of operation of the apparatus 10 will now be described with reference to FIGS. 1, 2 and 3.

Initially, the desired mineral, such as phosphate or coal, is removed from the ground in bulk and is mixed in a slurry with well-known emulsifiers and surfactants. The slurry is then fed through the intake port 26 into the first chamber 12. Air is fed through the feed pipes 38 and 40, and into the infusers 44 via the tubing 48. Water is likewise fed through the pipes 42 into the infusers 44 via the tubes 50.

Reference is now made to FIGS. 4 and 5. Air under pressure is fed through the nipple 88 and the tube 86 into the outlet 90. Likewise, water is fed through the nipple 84 into the first hole 70 and through the passageway 72 into the cavity 68. Because of the position of the passageway 72, the water is fed into the cavity with a centrifugal force which causes the water to swirl out of the outlet 82 with a centrifugal swirling action which breaks up the air passing out of the outlet 90 into tiny bubbles which are then spread outwardly by the force of the water passing out of the outlet 82.

Reference is again made to FIGS. 2 and 3. The air bubbles passing out of the infusers 44 bubbles upward through the chamber 12 and carries the desired minerals upward into the top of the chamber 12, in accordance with the standard procedure in a flotation separation process. Likewise, the heavier materials sink to the bottom of the chamber 12 and against the bulkhead 16. However, as noted above, the tailings frequently include heavier masses of the desired mineral being extracted. In accordance with the present invention, the plug 54 is controlled so as to allow the tailings from the first chamber 12 to pass with the slurry into the lower chamber 18 through the intake 427. After the lower chamber 18 has been filled with the slurry, bubbling of air from the infusers 44 and the lower chamber 18 is continued, and additional amounts of the desired mineral are likewise removed from the slurry and are passed out of the concentrated output port 53. The remaining tailings sink to the bottom of the lower chamber 18 and are passed out of the tailing outlet 52.

It will be understood by those skilled in the art that, prior to operation of the plug 54, a standard scraping or similar removal process takes place at the top of the first chamber 12 to remove the quantities of floated mineral which have been bubbled to the top of that chamber. The removed mineral from the top of the first chamber 12 may be fed together with the output of the concentrated outlet 53 for storage or further refining.

Apparatus in accordance with the present invention provides a means for the more efficient utilization of the flotation separation process, in order to extract the desired minerals from a slurry containing both the desired minerals and undesirable waste materials.

I claim:

1. Apparatus for separating and classifying diverse, liquid-suspended solids, comprising:

a first and second chamber chamber;

said first chamber being positioned over said second chamber in a stacked relationship means for feeding a slurry of said diverse, liquid-suspended solids into said first chamber;

means in said first chamber for bubbling a fluid having a specific gravity less than that of said liquid through said slurry to float predetermined solids in said slurry upward in said first chamber;

means for feeding said slurry from said first chamber into said second chamber;

means in said second chamber for bubbling said fluid through said slurry in said second chamber to float said predetermined solids therein upwards in said second chamber;

slurry feeding means coupling said first chamber with said second chamber, whereby said slurry may be gravity fed out of said first chamber into said second chamber; and means for controlling the flow of such slurry through such slurry feeding means, said means for controlling the flow of such slurry having a plug in said slurry feeding means, and means for moving said plug into and out of the flow of said slurry between said first and second chambers.

2. The apparatus recited in claim 1 wherein said bubbling means in said first and second chambers comprises:

a plurality of infusers spaced across each one of said first and second chambers;

a first fluid feed pipe extending across said first chamber;

means coupling said first feed pipe to said infusers in said first chamber;

a second fluid feed pipe extending across said second chamber; and means coupling said second feed pipe through said infusers in such second chamber.

3. The apparatus recited in claim 2 wherein each said infuser further comprises means for centrifugally spreading said bubbles away from each said infuser.

4. The apparatus recited in claim 3 wherein said spreading means comprises means for circulating a carrier liquid to each said infuser for spreading said fluid across the respective one of said first and second chambers.

5. The apparatus recited in claim 4 wherein said fluid comprises air.

6. The apparatus recited in claim 5 wherein said carrier liquid comprises water.

7. The apparatus recited in claim 4 wherein each said infuser comprises:

a housing having a cavity therein;

an outlet;

a fluid feed tube extending in said housing and communicating with said outlet; and means coupling said tube with a respective one of said first and second feed pipe coupling means.

8. The apparatus recited in claim 7 wherein each said carrier liquid circulating means comprises means for centrifugally feeding said carrier liquid into said cavity and thereby in a twirling centrifugal action out of said outlet, whereby said carrier liquid carrier said fluid at said outlet and spreads said fluid across the respective one of said first and second chambers.

9. The apparatus recited in claim 1 wherein said first chamber is positioned directly above said second chamber.

10. The apparatus recited in claim 9 further comprising a bulkhead between said first and second chambers, said slurry feeding means comprising a throat communicating between said first and second chambers through said bulkhead.

11. The apparatus recited in claim 10 wherein said float controlling means comprises a movable plug in said throat.

* * * * *